US005423435A

United States Patent [19]

Pollard et al.

[11] Patent Number: 5,423,435

[45] Date of Patent: Jun. 13, 1995

[54] MODULAR ROTATING SHOE RACK

[76] Inventors: Rosalie M. Pollard, 517 Stevenson St., Salinas, Calif. 93907; Clyde J. Beck, 14451 SE. 234th Pl., Kent, Wash. 98042

[21] Appl. No.: 236,716

[22] Filed: Apr. 29, 1994

[51] Int. Cl.[6] ..... A47F 7/00

[52] U.S. Cl. ..... 211/37; 211/163

[58] Field of Search ..... 211/37, 34, 163, 168, 211/169; 248/159

[56] References Cited

U.S. PATENT DOCUMENTS

| | | | |
|---|---|---|---|
| D. 76,856 | 11/1928 | D'Angelo | 211/37 X |
| 928,964 | 7/1909 | Hall | 211/34 |
| 2,973,867 | 3/1961 | Cohen | 211/37 |
| 3,135,389 | 6/1964 | Farley . | |
| 3,254,354 | 6/1966 | Lowe . | |
| 4,036,367 | 7/1977 | Stambaugh et al. . | |
| 4,915,238 | 4/1990 | Cassel . | |
| 4,946,048 | 8/1990 | Francois . | |
| 5,033,626 | 7/1991 | Platti . | |
| 5,050,746 | 9/1991 | Frankel . | |
| 5,065,871 | 11/1991 | Chan . | |
| 5,127,528 | 7/1992 | Cone . | |

OTHER PUBLICATIONS

Brochure of Storage Units by Mill's Pride, published prior to Apr. 29, 1994.

*Primary Examiner*—Alvin C. Chin-Shue
*Assistant Examiner*—Sarah L. Purol
*Attorney, Agent, or Firm*—David N. Lathrop; Thomas A. Gallagher

[57] ABSTRACT

A shoe rack comprising shoe storage members rotatable about a shaft are separated from one another by one or more spacers. Each storage member comprises a hub and a plurality of arms with supports which store shoes in a substantially vertical position. The storage members and spacers may be removed at one end of the shaft.

6 Claims, 3 Drawing Sheets

MODULAR ROTATING SHOE RACK

TECHNICAL FIELD

The present invention relates in general to shoe racks, and in particular to a rotatable shoe rack which may be easily adjusted to fit a range of applications.

BACKGROUND

There is a growing interest in efficient storage of wearing apparel and especially in efficient storage of shoes. A number of shoe racks of varying design have been developed with an objects directed toward improving the efficiency of shoe storage but each suffers from one or more limitations. Examples of such shoe racks are disclosed in U.S. Pat. Nos. 3,135,389, 3,254,354, 4,036,367, 4,915,238, 4,946,048, 5,033,626, 5,050,746, 5,065,871 and 5,127,528, which disclosures are incorporated herein by reference in their entirety.

Various shoe racks disclosed in U.S. Pat. Nos. 3,135,389, 3,254,354, 4,036,367 include a plurality of storage members which rotate about a shaft mounted on a base. The embodiments are portable and the rotatable storage members provide ready access to the shoes; however, the shoes are either stored in storage members which restrict air circulation, thereby promoting the growth of mildew and odor-causing bacteria, or the shoes are exposed to dust and dirt. In U.S. Pat. No. 4,036,367, a shoe rack is disclosed which has storage members storing shoes in a substantially horizontal position, allowing for reasonably good air circulation, and it provides dust covers to protect each tier of shoes. Unfortunately, the covers themselves accumulate dust, requiring attention to keep them clean. No provision is made to easily adjust the storage capacity of the disclosed shoe racks because storage members cannot be easily added or removed. Shoes of different sizes cannot be stored efficiently because no provision is made to adjust vertical spacing between storage members. Furthermore, convenience is impaired because no provision is made to adjust the height of the storage members above the floor.

U.S. Pat. No. 4,915,238 discloses a "Stackable Shoe Rack" which is portable, provides reasonable air circulation, minimizes exposure of the shoes to dust and dirt, and the rack itself accumulates very little dust. The storage capacity of the rack can be adjusted by installing additional storage members but the vertical spacing between members cannot be adjusted; therefore, shoes of different sizes cannot be efficiently stored and the height above the floor cannot be easily adjusted. Furthermore, access to some shoes can be difficult because the storage members do not rotate.

U.S. Pat. No. 4,946,048 discloses an "Adjustable Shoe Carousel" which rotates, allows adjustment of the height of the storage member above the floor, and allows for good air circulation; however, the shoes are exposed to dust and the storage capacity of the rack is very limited because only one storage member is disclosed. Because of the complexity of the structure, embodiments with additional members may be impractical. Even if the addition of members is practical, no provision is made for adjusting the vertical spacing between storage members.

U.S. Pat. No. 5,033,626 discloses a "Rotating Shoe Enclosure Rack" which is portable, allows tiers of storage members to be added and removed as desired, provides reasonable air circulation, and provides protection against dust; however, the top surface of the rack does require attention to keep it clean and each tier of storage members cannot be adjusted to accommodate shoes of different sizes. The largest shoe which can be stored in a tier is fixed at the time of manufacture.

U.S. Pat. No. 5,050,746 discloses a "Rotary Shoe Rack" of storage members which store shoes in a substantially horizontal position, thereby exposing the shoes to dust. The rack is not portable and storage members cannot be easily added or removed because the rack requires both a lower and an upper support. Although no details are disclosed, an embodiment is mentioned only briefly which allows for adjusting the vertical spacing between storage members.

U.S. Pat. No. 5,065,871 discloses a "Multi-deck Type of Rotary Shoe Rack" which has rotatable storage members and allows for reasonable air circulation. No provision is made for adjusting the vertical spacing between the storage members. Furthermore, shoes are not stored very securely because they dangle from rods protruding from sockets separated by sleeves.

U.S. Pat. No. 5,127,528 discloses an "Extendible Rotary Shoe Rack" which provides rotatable storage members which minimize shoe exposure to dust and dirt by storing the shoes in a substantially vertical position. Unfortunately, the rack is not portable because it requires both a lower and an upper support. Storage capacity may be adjusted by adding or removing hook-like members to a central column; however, the shoe rack is expensive to manufacture because its structure is fairly complex.

DISCLOSURE OF INVENTION

It is an object of the present invention to provide for a shoe rack with rotatable storage members which can be easily added and removed to adjust the storage capacity.

It is another object of the present invention to provide for a shoe rack in which spacing between storage members may be easily adjusted.

It is yet another object of the present invention to provide for a shoe rack having a rotatable storage member which allows for reasonable air circulation, minimizes shoe exposure to dust and dirt, and is reasonably free from dust accumulation.

It is a further object of the present invention to provide for a shoe storage rack with multiple tiers of rotatable storage members whose height above the floor may be easily adjusted.

It is yet a further object of the present invention to provide for a shoe rack which can be constructed inexpensively and can be easily assembled and disassembled.

These objects and yet other objects set forth herein are achieved by the invention as claimed.

According to the teachings of the present invention in one embodiment, a shoe rack comprises a shaft mounted on a lower support such as a base, a plurality of rotatable storage members rotatable about the shaft, each storage member comprising a hub and a plurality of arms attached to the hub each having one or more shoe supports, and one or more spacers around the shaft located between hubs of adjacent storage members.

Many alternatives are possible. For example, an embodiment without a lower support is possible by suspending the shaft from an upper support. In a preferred embodiment, the shoe supports store shoes in a substantially vertical position, thereby reducing exposure to dust and dirt yet allowing reasonably good air circulation.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

Figure 1:
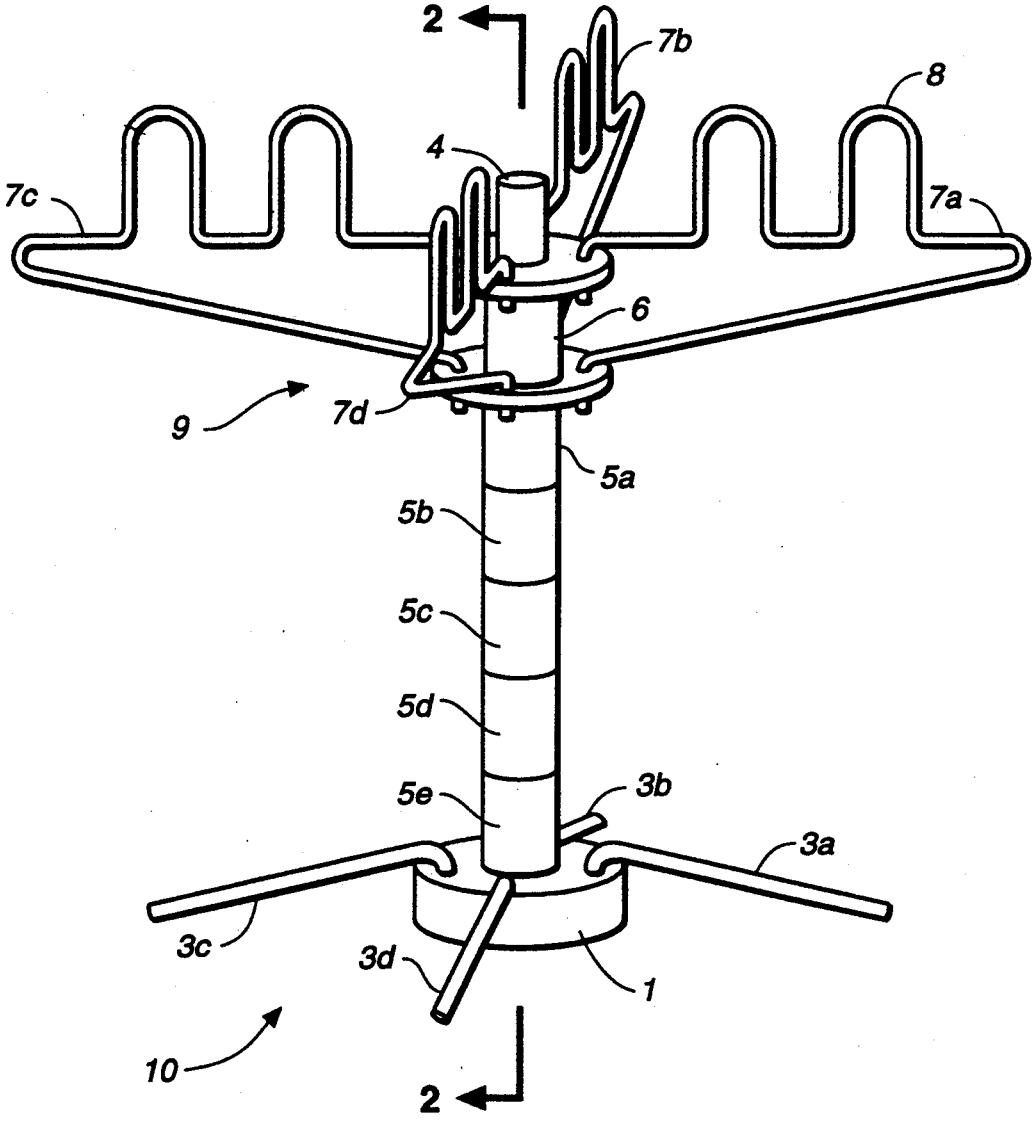
FIG. 1 is a perspective view of one embodiment of a shoe rack.

FIG. 1 illustrates one embodiment of a single-tier shoe rack 10 comprising a base 1 with a plurality of support legs 3*a*–3*d* to improve stability, shaft 4 around which spacers 5*a* –5*e* provide vertical spacing for a shoe storage member 9. Storage member 9 comprises hub 6 rotatable about shaft 4 and arms 7*a*–7*d* connected to hub 6. Each arm includes shoe supports 8 for storing a shoe in a substantially vertical position.

Many alternative embodiments are possible. Base 1 may be of any convenient shape, size and mass to provide support for the shoe rack. Support legs may not be needed if base 1 alone can provide sufficient stability. Base 1 may also be anchored to the floor or other lower surface if portability is not required.

FIG. 1 illustrates one storage member 9 comprising four arms 7*a* –7*d*, each having two shoe supports such as support 8. A storage member may comprise any convenient number of arms and each arm may comprise any convenient number of shoe supports. In one preferred embodiment, a storage member comprises five arms each having four shoe supports.

Figure 2:
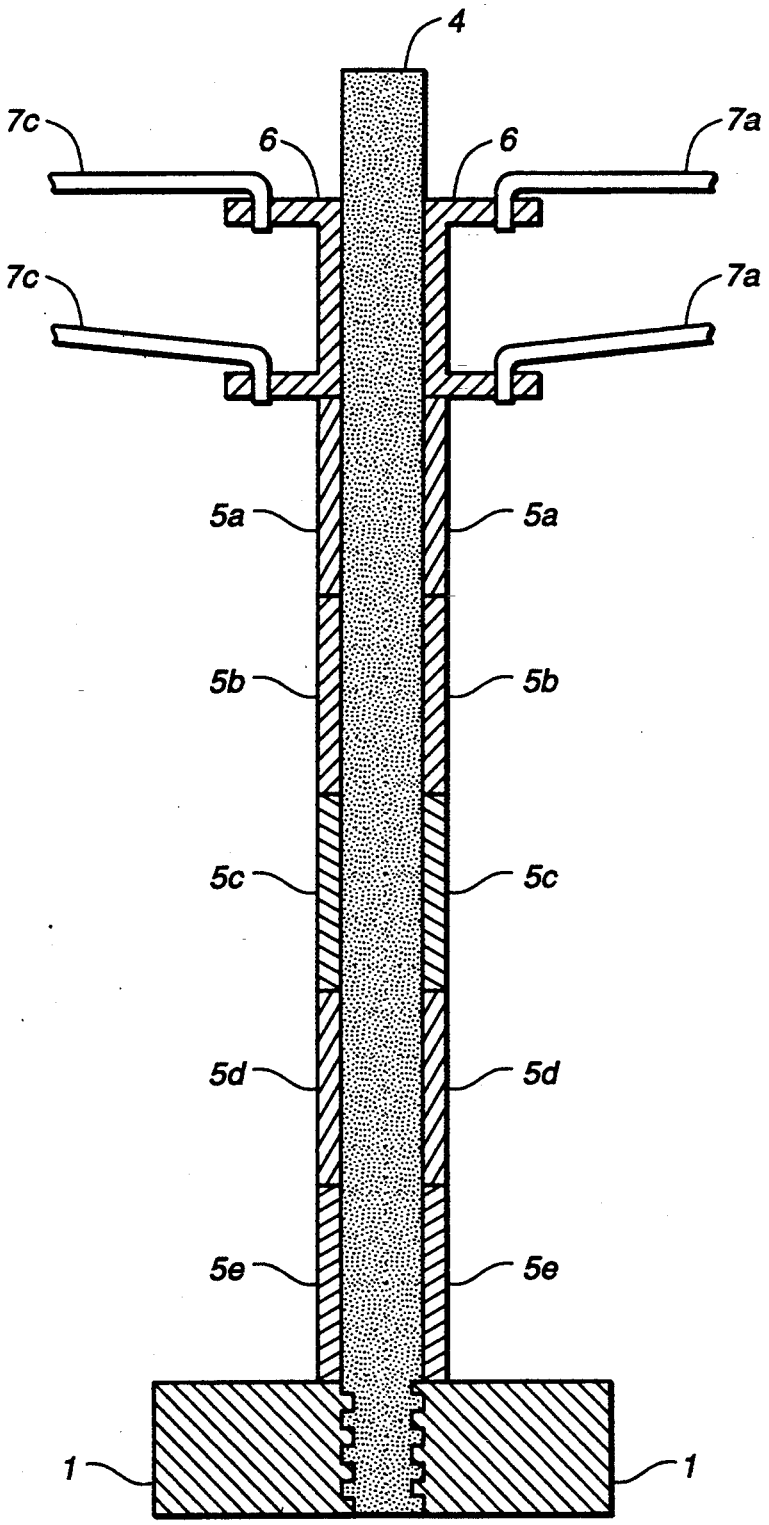
FIG. 2 is a cross-sectional view taken substantially along the plane of line 2—2 in FIG. 1.

FIG. 2 is a cross-sectional view of one embodiment of a shoe rack such as that illustrated in FIG. 1; however, no support legs are shown. In the embodiment shown, shaft 4 screws into base 1 but no particular structure of base and shaft is critical to the practice of the invention. Furthermore, shaft 4 is illustrated as a solid pole but it may be a hollow pipe or tubing. Spacers 5*a* –5*e* and hub 6 as shown are cylinders which may be slipped onto shaft 4 at one end opposite the end inserted into base 1. Arms 7*a* and 7*c* are constructed of heavy-gauge wire or rod bent into suitable shape, and the ends are inserted into holes formed in hub 6. Fasteners such as nuts, cotter pins or clips may be installed on the ends of the arms to prevent accidental removal from the holes in the hub, but such features are not critical to the practice of the present invention.

The shape and construction of the arms are not critical. For example, an arm having substantially the same outline as that illustrated may be formed from a solid piece. Alternatively, an arm may consist of a horizontal beam with vertical rods for shoe supports.

Figure 3A:
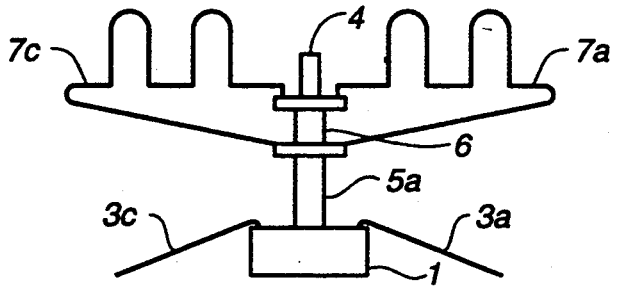
FIG. 3*a*–3*c* are elevation views of three embodiments of shoe racks.
Figure 3B:
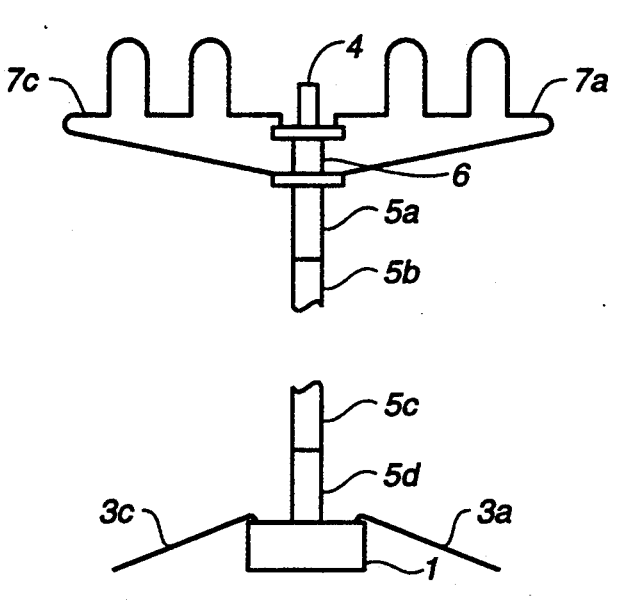
Figure 3C:
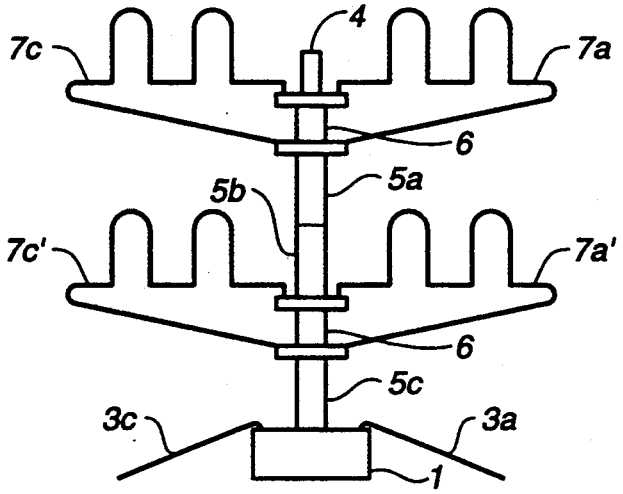

FIGS. 3*a* –3*c* illustrate three variations on the embodiments shown in FIGS. 1 and 2. The single-tier shoe rack shown in FIG. 3*a* comprises one spacer 5*a* and one storage member with hub 6 installed on a short shaft 4. The single-tier shoe rack shown in FIG. 3*b* comprises a plurality of spacers 5*a* –5*d* and one storage member with hub 6 installed on a long shaft 4. The double-tier shoe rack shown in FIG. 3*c* comprises spacers 5*a* –5*c* and two storage members with hubs 6 and 6' respectively installed on shaft 4. From these illustrations, it should be appreciated that a shoe rack may comprise any convenient number of storage members, and that the storage members may be separated by any convenient number of spacers. Furthermore, the height of each storage member above the floor may be established by using a desired number of spacers.

Equal-size spacers are shown in each of the illustrations but the present invention is not so limited. Spacers of any convenient size may be used.

The concepts of the present invention may also be applied to other embodiments. For example, a shoe rack incorporating various aspects of the present invention may comprise storage members substantially like the circular platters disclosed in U.S. Pat. Nos. 4,036,367 and 5,050,746 cited above.

We claim:

1. A shoe rack comprising a shaft with a principal axis, a plurality of storage members rotatable around said principal axis, and two or more spacers separating adjacent storage members along the principal axis of said shaft.

2. A shoe rack comprising a shaft with a principal axis, one or more storage members rotatable around said principal axis, and a plurality of spacers arranged in one or more groups of adjacent spacers, one spacer in each group adjacent to a respective storage member.

3. A shoe rack according to claim 1 or 2 wherein each of said storage members comprise a hub rotatable around said principal axis and one or more arms connected to said hub comprising one or more shoe supports.

4. A shoe rack according to claim 3 wherein said shoe supports store a respective shoe in substantially a vertical position.

5. A shoe rack according to claim 1 or 2 wherein said shaft has a first end and a second end, wherein said storage members and said spacers are substantially around said shaft and may be moved along said shaft such that they may be removed from said shaft at said first end.

6. A shoe rack comprising a shaft with a first end and a second end, plurality of storage means for storing shoes, wherein each of said storage means rotatable about said shaft and are removable from said shaft at said first end, and plurality of spacer means for spacing said plurality of storage means along said shaft, wherein each of said spacer means are removable from said shaft at said first end, and wherein adjacent ones of said storage means are spaced apart by two or more of said spacer means.

* * * * *